US006898900B2

(12) United States Patent
Haag et al.

(10) Patent No.: US 6,898,900 B2
(45) Date of Patent: May 31, 2005

(54) ELECTRONIC POSITION SENSOR FOR POWER OPERATED ACCESSORY

(75) Inventors: Ronald H. Haag, Clarkston, MI (US); Michael I. Chia, Cicero, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/102,090

(22) Filed: Mar. 20, 2002

(65) Prior Publication Data

US 2003/0177698 A1 Sep. 25, 2003

(51) Int. Cl.[7] ..... E05F 11/24
(52) U.S. Cl. ..... 49/342; 49/345; 296/56
(58) Field of Search ..... 49/339, 340, 341, 49/342, 345, 360; 296/50, 56

(56) References Cited

U.S. PATENT DOCUMENTS

| | | | | | |
|---|---|---|---|---|---|
| 3,008,111 | A | * | 11/1961 | Julie | 338/202 |
| 4,703,925 | A | * | 11/1987 | Jelinek et al. | 271/11 |
| 5,319,813 | A | * | 6/1994 | DiMatteo et al. | 5/81.1 C |
| 5,404,673 | A | * | 4/1995 | Takeda et al. | 49/28 |
| 5,670,853 | A | * | 9/1997 | Bauer | 318/286 |
| 5,832,664 | A | * | 11/1998 | Tajima et al. | 49/26 |
| 5,979,114 | A | | 11/1999 | Clark et al. | |
| 5,982,126 | A | * | 11/1999 | Hellinga et al. | 318/468 |
| 6,092,337 | A | | 7/2000 | Johnson et al. | |
| 6,198,244 | B1 | | 3/2001 | Hayden et al. | |
| 6,237,479 | B1 | * | 5/2001 | Douba | 100/43 |
| 6,318,025 | B1 | | 11/2001 | Sedlak | |
| 6,347,482 | B1 | * | 2/2002 | Takiguchi et al. | 49/28 |
| 6,378,671 | B1 | * | 4/2002 | Carlson | 188/267.2 |
| 6,405,485 | B1 | * | 6/2002 | Itami et al. | 49/280 |
| 6,423,035 | B1 | * | 7/2002 | Das et al. | 604/155 |
| 6,468,499 | B1 | * | 10/2002 | Balachandran et al. | 423/657 |
| 6,539,771 | B1 | | 4/2003 | Davidson et al. | |
| 6,546,780 | B1 | | 4/2003 | Palfenier et al. | |
| 6,575,517 | B2 | * | 6/2003 | Yamagishi et al. | 296/76 |

FOREIGN PATENT DOCUMENTS

JP 5-98867 * 4/1993

OTHER PUBLICATIONS http://www.etisystems.com/lcpdesign.htm, circa 1995.*

* cited by examiner

*Primary Examiner*—Gregory J. Strimbu
(74) *Attorney, Agent, or Firm*—Scott A. McBain

(57) ABSTRACT

An electronic position sensor for use with a power operated vehicle accessory, such as a power liftgate. The position sensor includes an elongated resistive circuit that is mounted such that it is stationary and extends along the path of a track portion of the power operated accessory. The position sensor further includes a contact nub mounted to a link member that moves within the track portion such that the contact nub is slidingly biased against the elongated circuit. As the link member moves under the force of a motor-driven output gear, the contact nub slides along the surface of the resistive circuit, thereby affecting the overall resistance of the circuit. The position sensor uses the overall resistance to provide an electronic position signal to an ECU, wherein the signal is indicative of the absolute position of the power operated accessory. Accordingly, the electronic position sensor is capable of providing an electronic signal that enables the ECU to track the absolute position of the power operated accessory.

15 Claims, 5 Drawing Sheets

ELECTRONIC POSITION SENSOR FOR POWER OPERATED ACCESSORY

FIELD OF THE INVENTION

This invention relates generally to a position sensor for use with a power-operated accessory, and more specifically, to an electronic position sensor for use with a power operated vehicle accessory, such as a power liftgate.

BACKGROUND OF THE INVENTION

With the advent of power operated vehicle accessories, such as power lift gates, power sliding doors, power deck lids, power swing doors, power sunroofs, etc., comes a need for position sensors capable of tracking the position of moving components. Sensing the position of these moving components is often necessary for accomplishing other tasks, for instance, controlling the speed at which the component is driven relative to its current position, calculating the amount of time between known positions to determine if the moving component has encountered an obstacle, etc. Various techniques have been employed for monitoring the position of moving components, one of which involves sensing the position of a component other than the actual power accessory, knowing the relationship between that separate component and the power operated accessory, and calculating the relative position of the power operated accessory based upon this relationship. For example, U.S. Pat. No. 5,979,114 issued Nov. 9, 1999 to Clark et al. discloses a power sliding door for use with a vehicle that includes a relative position sensing system for determining the position of the sliding door. This system includes position sensing means coupled to a clutch, wherein the sensing means produce an electronic signal indicative of the rotary position of the clutch which, in turn, is sent to an electronic control unit (ECU). Because the clutch is mechanically coupled to the drive mechanism which moves the sliding door, the ECU is capable of determining the relative position of the sliding door based upon the rotational position of the clutch. Accordingly, the relative position sensing system of the Clark patent does not measure the actual position of the sliding door, rather, it measures the rotational position of another component, the clutch, and the ECU utilizes that reading to calculate the relative position of the sliding door. Though relative position sensing systems, such as that just described, have been useful in the past, these techniques remain susceptible to certain drawbacks. For instance, if a relative position sensing system were to experience an unforeseeable power outage and the position data of the related component were lost, upon power restoration, the system would likely be unable to calculate the position of the power accessory without executing some type of recalibration sequence. Also, relative position sensing systems typically require significant tweaking before the system is capable of operating the power accessory in a precise, smooth manner. Accordingly, there exists a need for an absolute position sensing system that directly determines the position of the power-operated accessory.

Furthermore, there exists a need for a position sensor capable of tracking the position of a power operated vehicle accessory operating in either a power or a manual mode. Many power-operated accessories are now capable of being driven in either power or manual modes, a feature that gives the operator the ability to use whichever mode is most convenient. For instance, the power sliding door disclosed in the Clark patent is capable of both manual and power operation, therefore if the sliding door is being closed under the force of the power drive unit and an operator were to manually engage the door, they would be able to overtake operation of the door and complete the closing process manually. Thus, it is desirable that a position sensor coupled to a dual power/manual operated vehicle accessory, be able to track the position of the moving accessory component regardless of its mode of operation.

Moreover, there exists a need for providing a position sensor having a low power consumption feature, particularly if the vehicle accessory is capable of being manually operated. In the manual mode, the vehicle accessory can be left in a partially open position for an indefinite amount of time, thereby potentially causing significant power consumption if the electronic position sensor were to be provided with a normal amount of power. Therefore, electronic position sensors capable of low power consumption are advantageous, particularly when they are used in conjunction with power operated vehicle accessories that can also be manually operated.

Thus, it would be advantageous to provide an electronic position sensor for use with a power operated vehicle accessory, wherein the sensor is capable of tracking the absolute position of the accessory in either a power or a manual mode, and the sensor is further capable of being selectively operated in a low power consumption mode.

SUMMARY OF THE INVENTION

The present invention provides an electronic position sensor for use with a power operated accessory. The position sensor includes an elongated electronic circuit extending alongside a track portion of the power operated accessory, the circuit comprising an input terminal for receiving a power signal and an output terminal for providing an electronic position signal. The position sensor also includes a contact nub affixed to the power operated accessory and biased against the electronic circuit such that movement of the power operated accessory causes the contact nub to slide along the electronic circuit. Furthermore, the position of the contact nub with respect to the electronic circuit affects the electronic position signal which is representative of the absolute position of the power operated accessory.

The present invention also provides an electronic position sensing system for use with a power operated accessory. The system includes a power source for providing a power signal, an electronic position sensor, and an electronic control unit. The electronic position sensor comprises an elongated electronic circuit extending alongside the power operated accessory and having an input terminal coupled to the power source for receiving the power signal and an output terminal for providing an electronic position signal representative of the position of the power operated accessory. The electronic circuit also has a contact nub affixed to the power operated accessory and biased against the electronic circuit such that movement of the power operated accessory causes the contact nub to slide along the electronic circuit, wherein the position of the contact nub with respect to the electronic circuit affects the position signal. The electronic control unit includes an input terminal coupled to the electronic position sensor output terminal for receiving the position signal and an output terminal for providing an electronic control signal, wherein the control signal governs the application of the power signal to the electronic position sensor.

Objects, features and advantages of this invention include providing an electronic position sensor for use with a power operated accessory, wherein the sensor is capable of providing an electronic signal indicative of the absolute position of the accessory, the sensor is capable of tracking the position of the accessory during both manual and power operated modes, and the sensor is capable of being operated in a low power consumption mode.

BRIEF DESCRIPTION OF THE DRAWINGS

The preferred embodiment of the present invention is disclosed in the following description and in the accompanying drawings, wherein.

DETAILED DESCRIPTION OF THE EMBODIMENT

Figure 1:
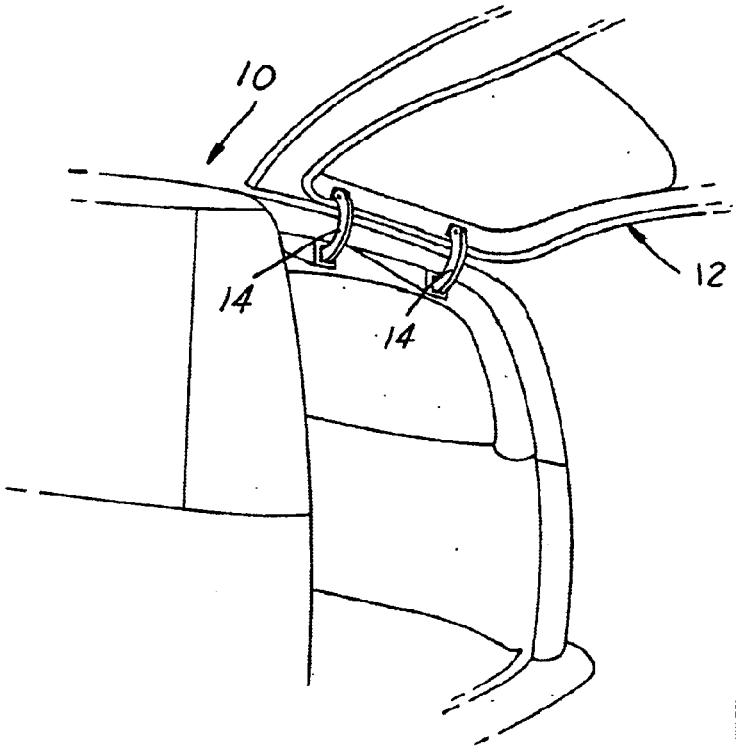
(Prior Art) FIG. 1
FIG. 1 is a perspective view of the aft end of a vehicle equipped with a power-operated liftgate, such as those known in the prior art.

Power operated accessories for vehicles, such as power lift gates, power sliding doors, power deck lids, power swing doors, power sunroofs, etc., are becoming increasingly popular, and with their rise in popularity comes the increased need for electronic position sensors capable of tracking their position. An example of a power operated accessory is shown in U.S. Pat. No. 6,092,337 issued Jul. 25, 2000 to Johnson et al., for a Vehicle Liftgate Power Operating System, the entire contents of which are incorporated herein by reference, and is seen in FIG. 1. Referring now to FIG. 1, wherein a vehicle 10 includes a power operated liftgate 12 that is pivotally attached to the aft-end of the vehicle roof by two hinge assemblies 14. The liftgate is capable of being pivotally moved between a closed position and an open position, as seen in FIG. 1, under the power of a motor-driven drive mechanism.

Figure 2:
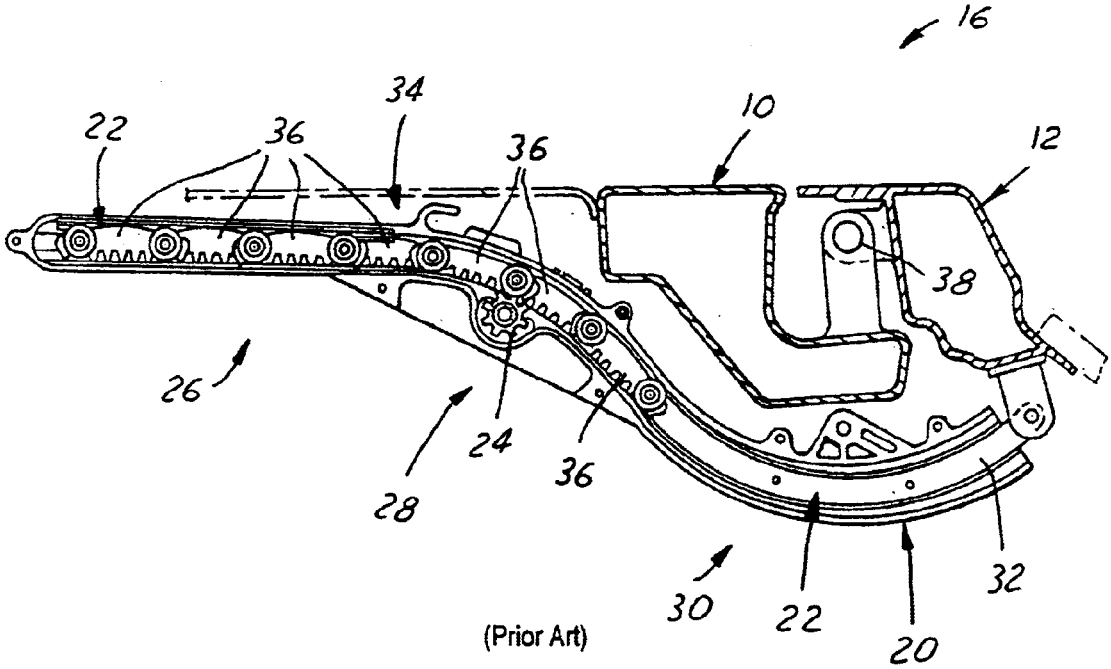
(Prior Art) FIG. 2
FIG. 2 is an enlarged cutaway view of a drive mechanism, such as those known in the prior art, that may be used with the liftgate of FIG. 1, wherein the liftgate is in a closed position.

Referring now to FIG. 2, the motor-driven drive mechanism previously mentioned is seen in further detail, and generally includes a track portion 20, a link member 22, and a motor-driven output gear 24. The track portion is designed to slidable receive the link member and is generally comprised of a straight section 26, a reverse curve section 28, and an arcuate section 30. The link member, on the other hand, is comprised of two distinct sections. A solid arcuate portion 32 is located in the arcuate section of the track when the liftgate is in a closed position, as in FIG. 2, and swings out of section 30 as the liftgate is opened. A segmented portion 34 of the link member is comprised of several distinct segments 36 and has geared teeth extending from its underside, such that when it is received in reverse curve section 28 the teeth engage teeth located on the output gear 24. As the liftgate is opened, the segmented portion moves from the straight section through the reverse curve section to the arcuate section, wherein its segmented form allows it to conform to the varying shapes of the different track sections. To open the liftgate, a reversible electric motor drives output gear 24 in a clockwise direction such that its teeth mesh with the teeth of segmented portion 34, thereby driving the link component within the track portion. One end of solid arcuate portion 32 is pivotally attached to liftgate 12, thus, as the link component is driven within the track, the arcuate portion extends out of the track and causes the liftgate to pivot about an axis 38. In this manner, the liftgate may be pivoted to a fully open position, at which point the motor-driven output gear stops driving the link component. To close the liftgate, the electric motor drives output gear 24 in a counter-clockwise direction such that the arcuate portion 32 is retracted back into the track. This causes the liftgate to pivot from the open to the closed position, thereby completing the closing process. For further detail on the structure and operation of the power operated liftgate just described, please refer to the Johnson patent referenced above.

The previous description of a power liftgate has been given as an example of a power operated accessory with which the electronic position sensor of the present invention can be used. However, it should be recognized that the present invention can be utilized with a wide variety of power operated accessories, the power lift gate simply being one of them. Accordingly, even though the subsequent description of the electronic position sensor of the present invention is made with specific reference to the power liftgate previously described, it is only intended for illustrative purposes and is in no way limited to that specific power operated accessory.

Figure 3:
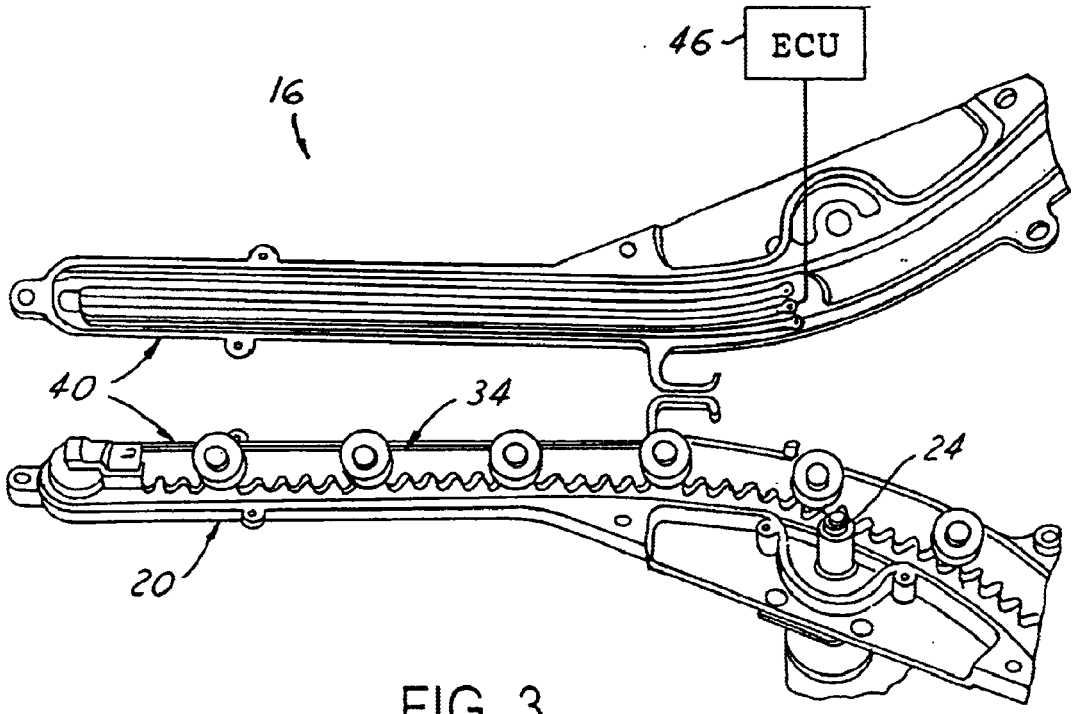
FIG. 3 is an enlarged view of the drive mechanism seen in FIG. 2 and includes the electronic position sensor of the present invention.

Referring now to FIG. 3, there is seen a portion of the motor-driven drive mechanism 16 of FIG. 2, wherein the drive mechanism housing has been opened to expose the interior components, including the electronic position sensor 40 of the present invention. Generally, the position sensor includes an elongated resistive circuit which can be mounted to either the inner or outer side of the drive mechanism housing such that the circuit extends along the path of track portion 20. The position sensor further includes a contact nub which is mounted to the segmented portion 34 of the link member such that the contact nub is slidingly biased against the elongated circuit. As the segmented portion moves within the track under the force of output gear 24, the contact nub slides along the elongated surface of the resistive circuit, thereby affecting the circuit's overall resistance. Position sensor 40 uses the overall resistance of the elongated circuit to provide a position signal to an ECU 46, wherein the signal is indicative of the position of the power operated accessory. Accordingly, the electronic position sensor of the present invention is able to provide an electronic signal that enables the ECU to track the position of the power liftgate or any other power operated accessory.

Figure 4:
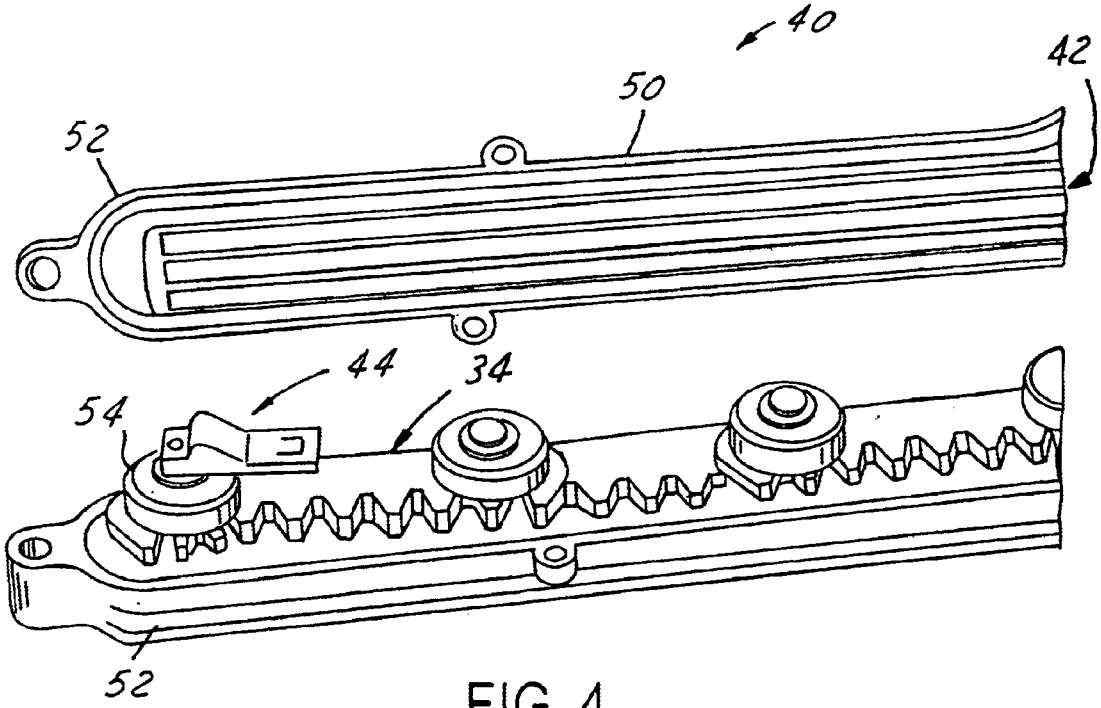
FIG. 4 is an enlarged view of the electronic position sensor seen in FIG. 3.

With reference to FIG. 4, an enlarged view of the electronic position sensor of the present invention is seen, wherein the sensor generally comprises an elongated resistive circuit 42 and a contact nub 44. The elongated circuit is essentially a flat potentiometer, and can be designed according to one of two embodiments. According to a first embodiment (not seen), the elongated circuit is located on the outer surface of drive mechanism housing 52, which has an elongated slot running along a length of the housing. Thus, contact nub 44 extends through the elongated slot such that it slidingly engages the elongated circuit located on the outer side of the housing. In a second embodiment (as seen in FIG. 4 and subsequently described), circuit 42 is designed to fit within an elongated channel 50 located on the inner side of the drive mechanism housing 52. Preferably, the elongated circuit is a polymer thick film linear potentiometer that has been screened onto a printed circuit board (PCB) and coated with a conductive overlay to environmentally protect it. The elongated circuit can include two or three terminals (3 terminal embodiment is shown in the Figures) and acts as a variable voltage divider, the variation depending upon the position of the sliding contact nub. Unlike the elongated circuit, which remains stationary either on the outer surface of the housing or within channel 50, the contact nub is affixed to the movable segmented portion 34. In the preferred embodiment, the contact nub is carried by a roller element 54 of the segmented portion, although any component of a moving member of the liftgate could be used, and is spring biased such that the contact nub is urged against the elongated circuit. In this manner, the contact nub acts as a wiping element of the potentiometer, capable of contacting and sliding along the conductive surface of the elongated circuit such that the overall resistance of the circuit is dependent upon the variable position of the contact nub. Even though elongated circuit 42 is depicted in a generally straight form, the circuit could easily be curved or of any other shape that might be necessary for the circuit to follow the path of a moving member of the power operated accessory. Such an application could employ a thick film material deposited onto a flexible substrate to aid in the flexibility of the circuit.

Figure 5:
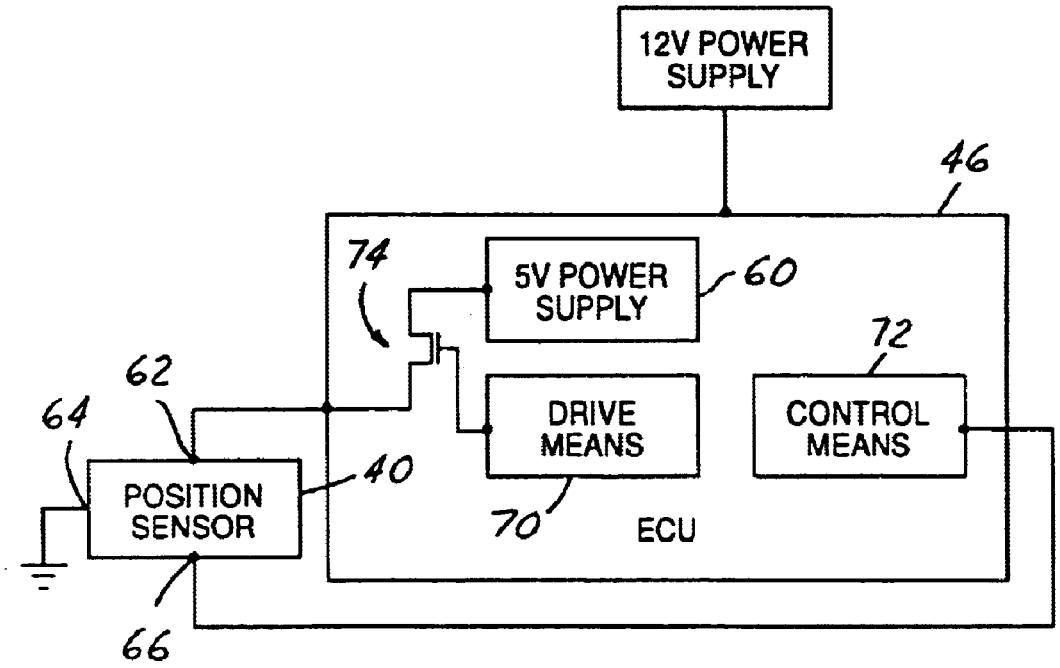
FIG. 5 is a block diagram including the electronic position sensor seen in FIG. 3.

With reference now to FIG. 5, there is seen a block diagram utilizing the electronic position sensor previously described, and generally includes electronic position sensor 40, ECU 46, and an external power supply. The position sensor has three basic terminals: an input terminal 62 for receiving a power signal, a ground terminal 64, and an output terminal 66 for providing a position signal, as also seen in FIG. 3. The ECU can be comprised of numerous electronic components and can assume one of numerous forms, as is well known in the art, but generally includes a drive means 70, a control means 72, and an internal power source 60. The drive means is coupled to a switch, such as MOSFET 74, such that it controls the application of the power signal to the position sensor 40. By selectively controlling the state of the switch, the ECU is capable of generally controlling the power consumption by the position sensor, a capability of particular interest when the power operated accessory is being used in a manual capacity, as will be explained. Control means 72, on the other hand, is coupled to output terminal 66, such that the position sensor provides the ECU with the electronic position signal. It should be noted, this particular embodiment is provided for illustrative purposes, as many alternative embodiments exist for utilizing the electronic position sensor of the present invention.

In operation, a reversible electric motor causes output gear 24 to rotate such that its gear teeth engage gear teeth located on the underside of segmented portion 34 of the link member. This engagement causes the link member to move within track portion 20 which thereby causes the power operated liftgate to pivotally move between open and closed positions, as previously discussed. As the segmented portion moves within the track, contact nub 44 slidably contacts the elongated circuit 42, thus resulting in a sliding electrical connection being established across the circuit. The position of the sliding connection on the circuit determines the overall resistance of the elongated circuit, as is commonly known in the art. Therefore, application of a constant voltage, such as 5.0 V, to the position sensor will result in the creation of an electronic position signal whose voltage is representative of the circuit's resistance, which in turn, is dependent upon the position of the power operated liftgate. The position signal generated by the position sensor is then sent to an ECU for processing tasks, such as motor control, executing a low power consumption program, as will be explained, or one of many other processing tasks commonly known in the art.

Accordingly, the position sensor of the present invention determines the absolute position of the link member, which is a movable component of the power liftgate. Unlike position sensors which track the relative position of a moving component, that is, a position that depends upon knowing a reference point or stored value, the position sensor of the present invention could experience data loss due to a power failure or some other type of malfunction, and upon being restored the sensor would be capable of immediately determining the position of the liftgate. A relative position sensor, for example, could be coupled to the motor-driven output gear 24 and would need to store the total number of gear revolutions, as well as the instantaneous angular position of the gear in order to determine the overall position of the liftgate. Any type of power outage or system malfunction that erased the total number of gear revolutions would require the relative position sensor to use a recalibration technique of some kind for recovering the lost information. The position sensor of the present invention, however, could immediately take a new absolute position reading and provide the ECU with the position signal.

Furthermore, the electronic position sensor of the present invention is capable of tracking the absolute position of a power-operated accessory being operated in either a power or a manual mode. This ability is beneficial, as most power operated accessories can also be operated in a manual mode, thus providing the electronic position of the present invention increased flexibility.

Figure 6:
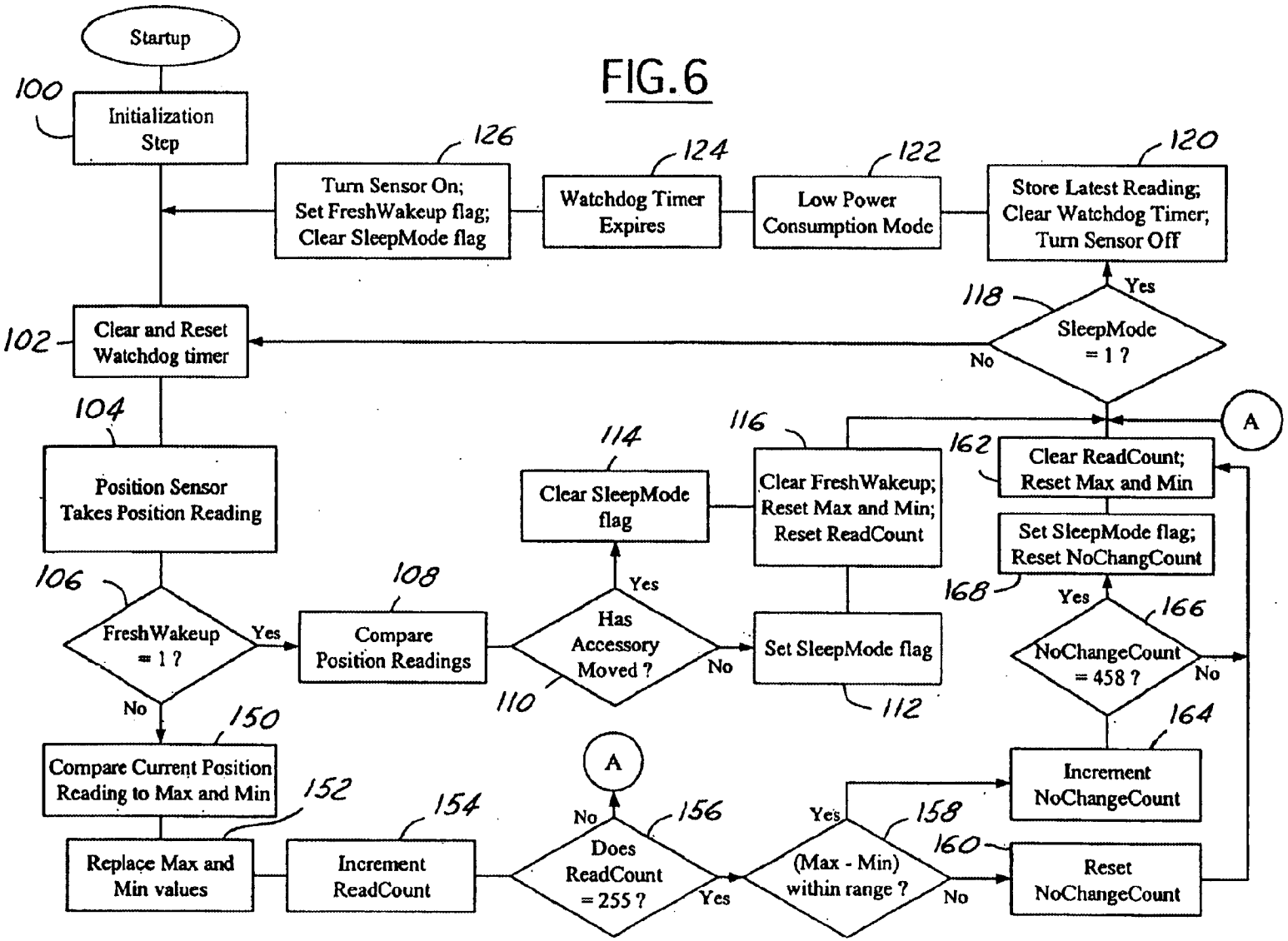
FIG. 6 is a flowchart describing the operation of an electronic control unit (ECU) that utilizes the output from the electronic position sensor seen in FIG. 3, the operation includes a low power consumption mode.
Figure 7:
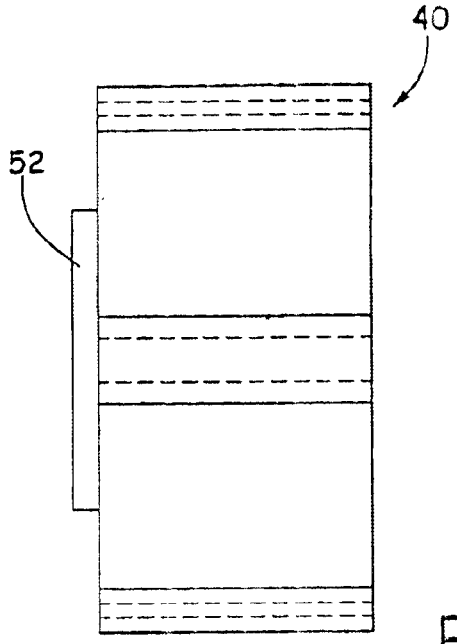
FIG. 7 is a view of the position sensor circuit located on an outer surface of the housing.
Figure 8:
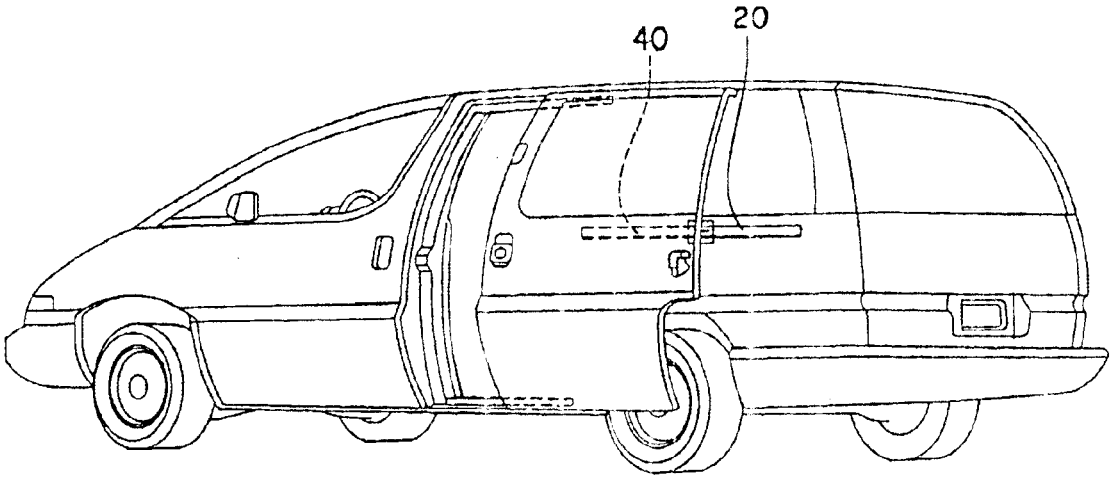
FIG. 8 is a view of the electronic position sensor in combination with a sliding door of a vehicle.

Referring now to FIG. 6, there is seen a flowchart describing the steps that the ECU uses in order to operate the position sensor of the present invention, including operating the sensor in a low power consumption mode. In the low power consumption mode, the ECU is capable of decreasing power consumption by the electronic position sensor by selectively turning power to the sensor on and off via an electronic switch, such as a transistor. Upon startup, the ECU is powered up and implements the instructions beginning with Initialization step 100. The Initialization step includes several housekeeping duties, such as initializing an internal Watchdog timer, input and output ports, A/D converters, interrupts, and any program variables that may need to be initialized. Step 102 clears and resets the Watchdog timer, after which, step 104 instructs the ECU to take a position reading of the accessory from the electronic position sensor. Step 106 compares the Fresh Wakeup flag, which was set to 1 in step 100 and indicates when the program is on its initial cycle through the software following an initial startup or fresh wakeup from the low power consumption mode, as will be explained. If the Fresh Wakeup flag equals 1, then step 108 compares the current position reading of the accessory to a previous position reading to determine whether or not the accessory has moved. If step 110 determines that the two position readings are within a predetermined range, thus taking into account negligible differences in the position signal, then the Sleep-Mode flag is set, step 112. If the position readings are out of the allowable range, thus suggesting the accessory has moved, then the SleepMode flag is cleared (set to 0), step 114. Regardless of the state of the SleepMode flag, step 116 clears the FreshWakeup flag and ReadCount variable and resets Max and Min values. If the accessory has not moved, thus resulting in the SleepMode flag being set, step 118 directs the sensor to store the latest position reading, clear the Watchdog timer, and turn the sensor off, step 120. This causes the sensor to enter a low power consumption mode, step 122, during which time the electronic position sensor of the present invention does not receive a power signal from a power source. When the watchdog timer expires at step 124 (every 250 ms), the ECU wakes the sensor up, and the ECU again sets the FreshWakeup flag to 1 and clears the SleepMode flag, step 126. As seen in the flow chart, this sequence of steps continues until step 110 determines that the accessory has moved by more than the allowed range, at which time step 114 clears the SleepMode flag and step 116 clears the FreshWakeup flag. Thus, step 118 sends control of the program to step 102 which sends control to decision step 106. Because the FreshWakeup flag was cleared in step 116 and has not been reset, decision step 106 will not allow the program to proceed to step 108, as was previously the case.

Instead, the current position reading is compared against the Max and Min values to see if the current position of the accessory exceeds either of these values, step 150. If the current position reading falls outside of the previous Max and Min value range, the old Max or Min value is replaced by the new position reading, step 152. Steps 154 and 156 combine to create a counter that expires approximately every 131 ms by incrementing the ReadCount counter, which had been reset in step 116, until it reaches 255. During those cycles leading up to the expiration of the ReadCount counter, the ECU repeatedly executes steps 118, 102–6, and 150–6, thereby constantly updating the Max and Min values while not altering either the SleepMode or the FreshWakeup flags. After the ReadCount counter reaches its limit, step 158 calculates the difference between the Max and Min values, step 158, and if the difference exceeds a predetermined value, thus indicating significant movement of the accessory, a NoChangeCount counter is reset, step 160. Accordingly, the sensor would remain in a normal operation mode and control would pass to step 162, where the ReadCount flag is cleared and the Max and Min values are reset. At this point, the 255 cycle ReadCount counter would start over and normal operation would proceed as before.

If after the 255 increments of the ReadCount counter, step 158 detected no appreciable movement, then step 164 would increment the NoChangeCount counter. As long as the NoChangeCount counter remains less than 458, step 166, the position sensor continues to operate in a normal mode by proceeding to step 162. When the NoChangeCount counter has been incremented such that it has a value exceeding 458, meaning the difference between the Max and Min position values of the accessory has remained below a certain threshold for 1 min. (131 ms*458=59.99 s), the ECU begins to prepare the sensor for low power consumption mode by transferring control to step 168. Step 168 sets the SleepMode flag to 1 and resets the NoChangeCount counter, such that step 118 causes the sensor to enter low power consumption mode.

Execution of the previously described software enables an ECU to operate the electronic position sensor of the present invention in a low power consumption mode, an attribute that is most desirable when the power operated accessory being monitored is driven under manual force. Manual operation of the accessory presents the possibility that the operator will leave the accessory in a partially opened condition, a possibility that presents an increased chance of battery drain if it were not for the low power consumption feature. Thus, the low power consumption mode allows the electronic position sensor of the present invention to be better suited to track the position of a vehicle accessory regardless of its mode of operation. It should be noted, a low power consumption mode, such as that previously described, could be implemented through one of any number of specific embodiments. For example, step 100 could initially set the FreshWakeup flag to 0, such that the program began operating in the normal mode sequence and did not progress to the low power consumption mode until the accessory was stationary for the requisite period of time. Also, all of the particular values used in the previous description could be substituted for other values, depending upon the particular application. Furthermore, the program itself could be alternatively structured and still provide an electronic position sensor with a low power consumption mode.

It will therefore be apparent that there has been provided in accordance with the present invention an electronic position sensor for use with a power operated vehicle accessory which achieves the aims and advantages specified herein. It will, of course, be understood that the foregoing description is of preferred exemplary embodiments of the invention and that the invention is not limited to the specific embodiments shown. Various changes and modification will become apparent to those skilled in the art and all such changes and modifications are intended to be within the scope of the present invention.

What is claimed is:

1. In a power operated closure system for opening and closing a closure, the closure having a power driven member that moves in a generally elongated track for moving the closure between open and closed positions, the improvement comprising an electronic control for controlling the movement of the closure, and a position sensor for signaling the electronic control, the position sensor comprising:

an elongated resistive circuit extending alongside a portion of the track, the circuit comprising an input terminal for receiving a power signal and an output terminal for providing a position signal, and a contact nub affixed to the power driven member and biased against said circuit such that the movement of the closure causes said contact nub to slide along said circuit, wherein the position of said contact nub with respect to said circuit affects said position signal which is representative of an absolute position of the closure.

2. The combination of claim 1, wherein said elongated circuit comprises a potentiometer.

3. The combination of claim 2, wherein said elongated circuit comprises a printed circuit board.

4. The combination of claim 1, wherein the closure is a swing door for a vehicle.

5. The combination of claim 1, wherein said elongated circuit further comprises a ground terminal.

6. The combination of claim 1, wherein said elongated circuit is located on an outer surface of a housing.

7. The combination of claim 1, wherein said position sensor can be operated in a low power consumption mode when the movement of the closure does not exceed a predetermined amount over a predetermined amount of time.

8. The combination of claim 7, wherein said low power consumption mode includes selectively supplying said power signal to said input terminal.

9. The combination of claim 1, wherein said position sensor can provide said position signal during power or manual operation of the power operated closure system.

10. The combination of claim 1, wherein the closure is a lift gate for a vehicle.

11. The combination of claim 1, wherein the closure is a sliding door of a vehicle.

12. In a power operated closure system for opening and closing a closure, the closure having a power driven member that moves in a generally elongated track for moving the closure between open and closed positions, the improvement comprising an electronic control for controlling the movement of the closure, and a position sensor for signaling the electronic control, the position sensor comprising:

an elongated resistive circuit extending alongside a portion of the track, the circuit comprising an input terminal for receiving a power signal and an output terminal for providing a position signal, and a contact nub affixed to the power driven member and biased against said circuit such that the movement of the closure causes said contact nub to slide along said circuit, wherein the position of said contact nub with respect to said circuit affects said position signal which is representative of an absolute position of the closure, wherein said elongated resistive circuit is affixed to an interior wall of a housing such that when the housing is in place said circuit extends alongside the portion of the track.

13. A power operated closure system for opening and closing a closure comprising:

a power driven link member that moves in a generally elongated track for moving the closure between open and closed positions, an electronic control for controlling the movement of the closure, and a position sensor for signaling the electronic control, said position sensor comprising:

an elongated electronic circuit extending alongside a portion of the track, said electronic circuit comprising an input terminal for receiving a power signal and an output terminal for providing an electronic position signal, and a contact nub that is affixed to a roller element of the link member and that is spring biased against said elongated electronic circuit such that the movement of the closure causes said contact nub to slide along said electronic circuit, wherein the position of said contact nub with respect to said electronic circuit affects said electronic position signal which is representative of an absolute position of the closure.

14. A power operated closure system for opening and closing a closure comprising:

a power driven link member that moves in a generally elongated track for moving the closure between open and closed positions;

a power source for providing a power signal, an electronic position sensor including:

an elongated electronic circuit extending alongside the track and having an input terminal coupled to said power source for receiving said power signal and an output terminal for providing an electronic position signal representative of an absolute position of the closure, and a contact nub affixed to the link member and biased against said electronic circuit such that the movement of the closure causes said contact nub to slide along said electronic circuit, wherein the position of said contact nub with respect to said electronic circuit affects said electronic position signal, and an electronic control unit having an input terminal coupled to said electronic position sensor output terminal for receiving said electronic position signal and an output terminal for providing an electronic control signal, wherein said control signal governs the application of said power signal to said electronic position sensor.

15. The power operated closure system of claim 14, wherein said electronic control unit is capable of utilizing a low power consumption mode to produce said control signal.

* * * * *